US011060299B2

(12) United States Patent
Dickson et al.

(10) Patent No.: US 11,060,299 B2
(45) Date of Patent: Jul. 13, 2021

(54) BRICK TIE

(71) Applicant: IBACOS, Inc., Pittsburgh, PA (US)

(72) Inventors: Bruce Dickson, West Mifflin, PA (US); Tim Kampert, Pittsburgh, PA (US)

(73) Assignee: IBACOS, Inc., Pittsburgh, PA (US)

( * ) Notice: Subject to any disclaimer, the term of this patent is extended or adjusted under 35 U.S.C. 154(b) by 0 days.

(21) Appl. No.: 16/535,216

(22) Filed: Aug. 8, 2019

(65) Prior Publication Data

US 2020/0048914 A1 Feb. 13, 2020

Related U.S. Application Data

(60) Provisional application No. 62/716,001, filed on Aug. 8, 2018.

(51) Int. Cl.

| | |
|---|---|
| ***E04B 1/41*** | (2006.01) |
| ***E04F 13/22*** | (2006.01) |
| ***E04F 13/14*** | (2006.01) |
| ***E04F 13/08*** | (2006.01) |

(52) U.S. Cl.

CPC ..... *E04F 13/22* (2013.01); *E04F 13/0885* (2013.01); *E04F 13/142* (2013.01)

(58) Field of Classification Search

CPC .... E04B 1/4178; E04B 1/4185; E04B 1/7616; E04B 1/6015; E04F 13/0846; E04F 13/0864

See application file for complete search history.

(56) References Cited

U.S. PATENT DOCUMENTS

| | | | | |
|---|---|---|---|---|
| 1,646,312 | A * | 10/1927 | Perkins | E06B 1/6038 52/714 |
| 1,697,760 | A * | 1/1929 | Foans | E04B 1/4178 52/508 |
| 2,262,130 | A * | 11/1941 | Bagley | E04B 1/4178 52/714 |
| 3,389,525 | A * | 6/1968 | Moody | E04F 13/0857 52/714 |
| 5,207,043 | A | 5/1993 | McGee et al. | |
| 5,392,581 | A * | 2/1995 | Hatzinikolas | E04B 1/4185 52/379 |
| 5,456,052 | A * | 10/1995 | Anderson | E04B 1/4185 52/379 |
| 5,816,008 | A | 10/1998 | Hohmann | |
| 6,212,841 | B1 | 4/2001 | Plume | |
| 6,990,778 | B2 | 1/2006 | Passeno | |
| 7,225,590 | B1 | 6/2007 | diGirolamo et al. | |
| D575,633 | S * | 8/2008 | Thornton | D8/384 |
| 8,240,103 | B2 * | 8/2012 | Riepe | E04B 1/4178 52/309.4 |

(Continued)

OTHER PUBLICATIONS (https://web.archive.org/web/20180624230942/https://www.h-b.com/). (Year: 2018).*

Fero Corrugated Strip Tie Technical Sheet, 2014 (Year: 2014).*

*Primary Examiner* — Brian E Glessner
*Assistant Examiner* — Daniel J Kenny
(74) *Attorney, Agent, or Firm* — The Webb Law Firm

(57) ABSTRACT

A brick tie including a body member, a first protrusion extending from a first location on the body member, and a second protrusion extending from a second location on the body member. The first and second protrusions may extend in the same direction relative to the body member. A gap may be defined between the first and second protrusions.

7 Claims, 5 Drawing Sheets

(56) References Cited

U.S. PATENT DOCUMENTS

| | | | | |
|---|---|---|---|---|
| D697,394 | S * | 1/2014 | Lengacher | D8/394 |
| 8,863,460 | B2 | 10/2014 | Hohmann, Jr. | |
| 8,904,731 | B2 * | 12/2014 | Hohmann, Jr. | E04B 1/4178 52/713 |
| 9,163,411 | B2 * | 10/2015 | Brady | E04F 13/045 |
| 9,995,044 | B2 * | 6/2018 | Suzuki | E04B 1/40 |
| 2007/0151190 | A1 * | 7/2007 | Huff | E04F 13/0846 52/592.5 |
| 2008/0053035 | A1 * | 3/2008 | Rosenberg | E04B 2/7457 52/483.1 |
| 2011/0277397 | A1 | 11/2011 | Hohmann, Jr. | |
| 2012/0272604 | A1 * | 11/2012 | Carbines | E04F 13/0803 52/478 |
| 2019/0127971 | A1 * | 5/2019 | Stauffer | E04B 1/4178 |

* cited by examiner

BRICK TIE

CROSS REFERENCE TO RELATED APPLICATION

This application claims the benefit of U.S. Provisional Patent Application No. 62/716,001, filed Aug. 8, 2018, the disclosure of which is incorporated in its entirety herein.

BACKGROUND OF THE INVENTION

Field of the Invention

The present disclosure is generally directed to brick ties and, in particular, to brick ties with an integrated stop to maintain a continuous air gap between a brick cladding and a frame structure.

Description of Related Art

Brick ties are commonly used in buildings with cavity walls. The brick ties are typically used to join the masonry cladding to the framed structure, allowing the two parts to act as a homogenous unit. Hidden from view after construction, brick ties assist in ensuring the stability of the wall cladding. Insufficient or poorly installed brick ties can lead to several structural issues, including damp penetration, masonry cracks, or collapse of the outer masonry cladding. Brick ties are often made from corrosion and fire resistant materials. Typically, brick ties are manufactured from galvanized steel to withstand corrosion from water and cement without requiring additional protection.

In standard brick tie installation, the brick ties are built into the mortar bed and connected to the frame wall during construction. To ensure the brick ties are effective at tying the systems together, the brick ties should be installed downward and then surrounded by fresh mortar. The brick ties are often installed with a slight angle of inclination to the outer brick cladding, not towards the frame wall which could provide a path for moisture to cross the cavity.

According to national building codes, anchoring single wythe brick cladding structures to a frame structure of a home or commercial building is required. In the residential sector, this anchoring is typically achieved by using corrugated flat strap brick ties that are bent and installed by the mason. The current brick ties available to masons do not include any type of stop or gauge to assist the mason in maintaining a defined clearance gap, often a 1" airspace gap, between the brick cladding and the frame wall. Currently, brick cladding is installed with a standard flat metal strap brick tie that must be hand folded on one side and fastened to the sheathing during the bricklaying process. Current brick ties do not create any type of stop or guidance to the mason to assist in maintaining a clearance gap. In many instances, the clearance gap is too narrow and does not provide adequate drainage or drying potential to the cavity between the brick cladding and the wall sheathing or frame structure, which has the potential to lead to wood rot and structural damage to the frame structure of the house.

SUMMARY OF THE INVENTION

In view of the foregoing, there is a current need for a brick tie that includes a stop or gauge for maintaining a defined clearance gap between a brick cladding and a frame wall.

In one aspect of the present disclosure, a brick tie may include a body member, a first protrusion extending from a first location on the body member, and a second protrusion extending from a second location on the body member, in which the first and second protrusions extend in the same direction relative to the body member, and in which a gap is defined between the first and second protrusions.

In another aspect of the present disclosure, the body member may include a first portion and a second portion. The first portion may include a plurality of ridges. At least one aperture may be defined in the first portion. The first protrusion may have a shorter length than the second protrusion. The second protrusion may define at least one aperture. The first protrusion may have a smaller width than the second protrusion.

In another aspect of the present disclosure, a building structure may include a brick cladding, and a frame structure spaced from the brick cladding. At least one brick tie may be positioned within the brick cladding to maintain a gap between the brick cladding and the frame structure. The brick tie may include a body member, a first protrusion extending from a first location on the body member, and a second protrusion extending from a second location on the body member, in which the gap is defined between the first and second protrusions.

In another aspect of the present disclosure, the body member may include a first portion and a second portion. The first portion may include a plurality of ridges. At least one aperture may be defined in the first portion. The first protrusion may have a shorter length than the second protrusion. The second protrusion may define at least one aperture. The first protrusion may have a smaller width than the second protrusion.

In another aspect of the present disclosure, a method of installing a brick cladding with a frame structure may include positioning a first row of bricks adjacent the frame structure, providing a first layer of mortar on the first row of bricks, positioning at least one brick tie on the first layer of mortar, in which the brick tie includes a first protrusion spaced from a second protrusion to maintain a gap between the first row of bricks and the frame structure, fastening the brick tie to the frame structure, providing a second layer of mortar on the brick tie and the first layer of mortar, and positioning a second row of bricks on the second layer of mortar, in which at least one brick of the second row of bricks abuts the first protrusion on the brick tie.

These and other features and characteristics of the brick tie, as well as the methods of installation of the brick tie, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE DISCLOSURE

Figure 1:
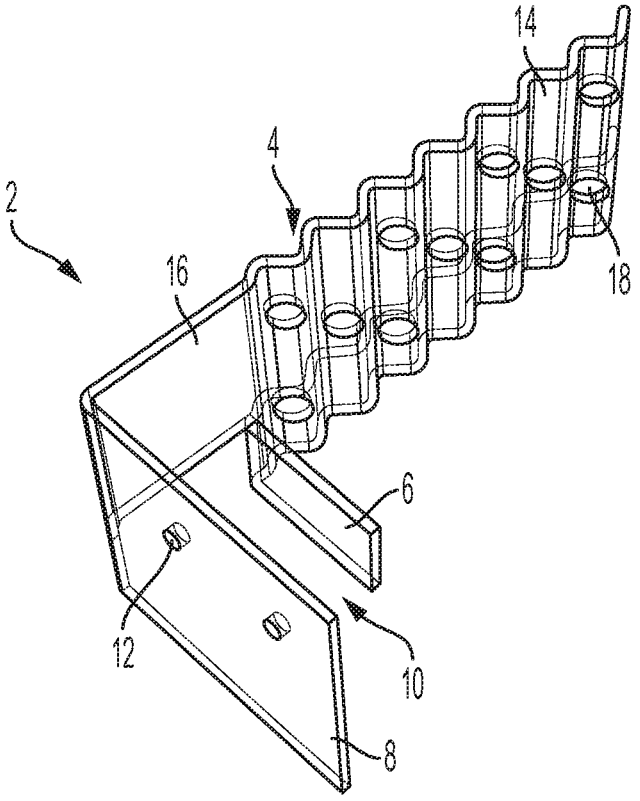
FIG. 1 is a perspective view of a brick tie according to an aspect of the present disclosure.

For purposes of the description hereinafter, the terms "upper", "lower", "right", "left", "vertical", "horizontal", "top", "bottom", "lateral", "longitudinal", and derivatives thereof, shall relate to the disclosed apparatus as it is oriented in the figures. However, it is to be understood that the apparatus of the present disclosure may assume alternative variations and step sequences, except where expressly specified to the contrary. It is also to be understood that the specific systems and processes illustrated in the attached drawings, and described in the following specification, are simply exemplary examples of the apparatus disclosed herein. Hence, specific dimensions and other physical characteristics related to the examples disclosed herein are not to be considered as limiting.

Referring to the drawings in which like reference numerals refer to like parts throughout the several views thereof, the present disclosure is generally directed to a brick tie and, more particularly, to a brick tie with a stop for maintaining a clearance gap. It is to be understood, however, that the brick tie may also be referred to as a wall tie. It is to be understood that the disclosed brick tie may be used in construction projects both residential and commercial in nature where brick masonry cladding is to be installed.

With reference to FIGS. 1-4, the brick tie 2 according to one aspect of the present disclosure is shown and described in detail. In one aspect, the brick tie 2 has a body member 4, a first protrusion 6 extending from the body member 4, and a second protrusion 8 extending from the body member at a distance from the first protrusion 6. In one aspect, the protrusions 6, 8 extend from a top surface of the body member 4. In a further aspect, the protrusions 6, 8 may extend at a substantially 90° angle from the body member 4. A gap 10 may be established between the first protrusion 6 and the second protrusion 8. The second protrusion 8 may have a longer longitudinal length than the first protrusion 6. In one aspect, the second protrusion 8 and the body member 4 may have the same width, while the first protrusion 6 has a smaller width than the body member 4 and the second protrusion 8. The body member 4, the first protrusion 6, and the second protrusion 8 may be substantially rectangular in shape.

Figure 3:
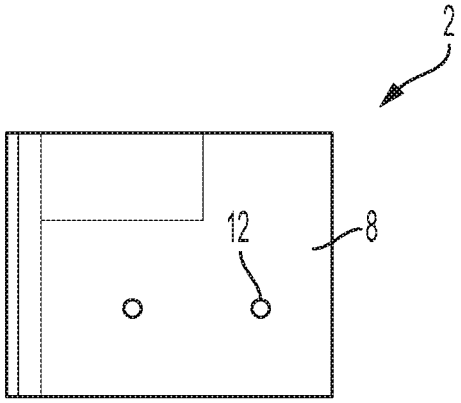
FIG. 3 is a front view of the brick tie of FIG. 1.
Figure 4:
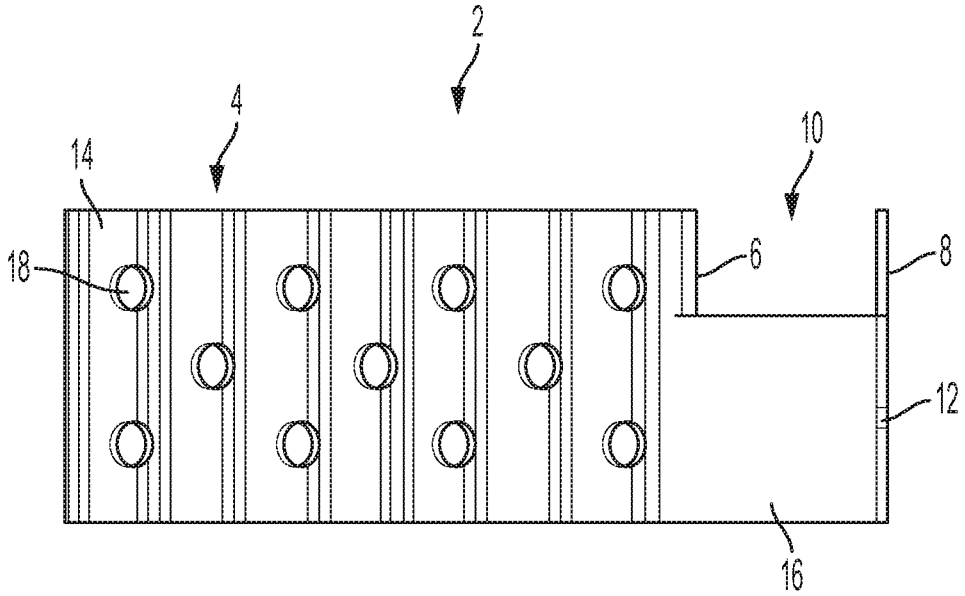
FIG. 4 is a top view of the brick tie of FIG. 1.

With reference to FIG. 3, the second protrusion 8 may define at least one aperture 12 configured to receive a fastening member, such as a nail, screw, bolt, or any other similar mechanical fastening arrangement. In one aspect, the second protrusion 8 defines two apertures 12 spaced apart from one another. As will be described in greater detail below, the apertures 12 may be provided to receive the fastening member to fasten the brick tie 2 to a frame structure.

Figure 2:
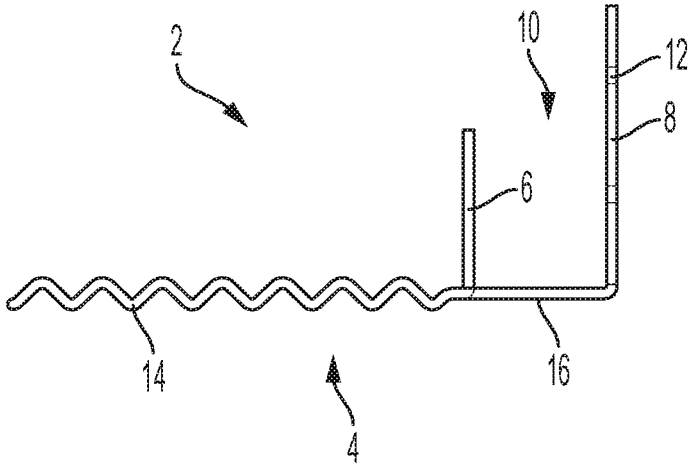
FIG. 2 is a side vie of the brick tie of FIG. 1.

With reference to FIGS. 1 and 2, in one aspect of the present disclosure, the body member 4 may include a first portion 14 that includes a plurality of ridges and grooves and a second portion 16 that is substantially planar. The plurality of ridges and grooves in the first portion 14 provides a plurality of peaks and valleys on the first portion 14. As will be described in greater detail below, the ridges and grooves assist in creating a greater bonding hold with the mortar supplied between bricks stacked on top of one another. The ridges create shear resistance in the mortar layer. It is also contemplated that the first portion 14 may be substantially flat without the plurality of ridges and grooves. In another aspect, to further assist in increasing the bonding hold between the two bricks, at least one aperture 18 may be defined in the first portion of the body member 4 to allow the mortar to pass through the body member 4. In one aspect, a plurality of apertures 18 may be defined in the first portion 14 of the body member 4. By permitting the mortar to flow through the apertures 18, a layer of mortar on top of the body member 4 and a layer of mortar beneath the body member 4 may be bonded together through the apertures 18 to increase the bonding of the mortar between the two stacked bricks.

Figure 5:
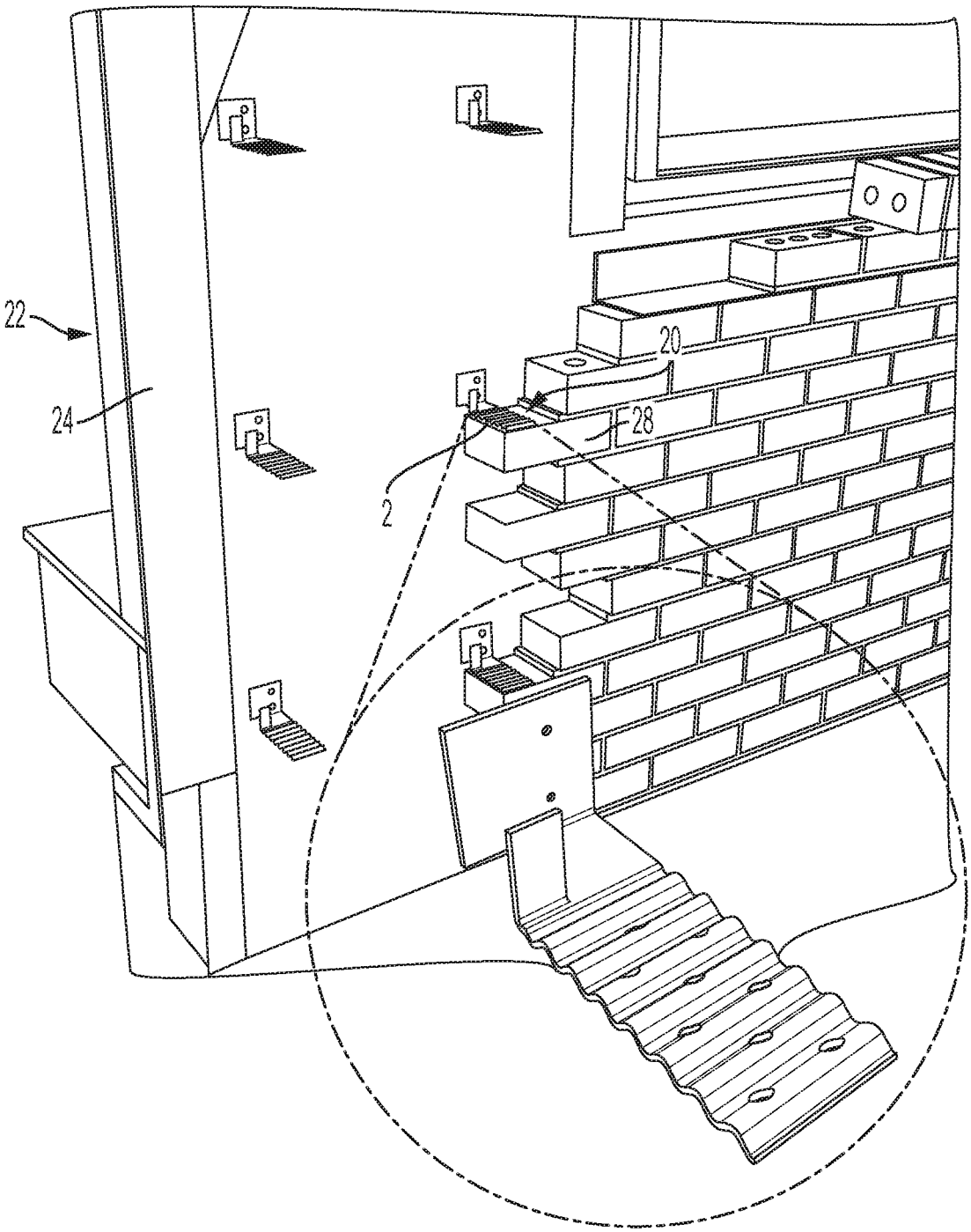
FIG. 5 is a perspective view of the brick tie of FIG. 1 positioned on a brick cladding and fastened to a frame structure.
Figure 6:
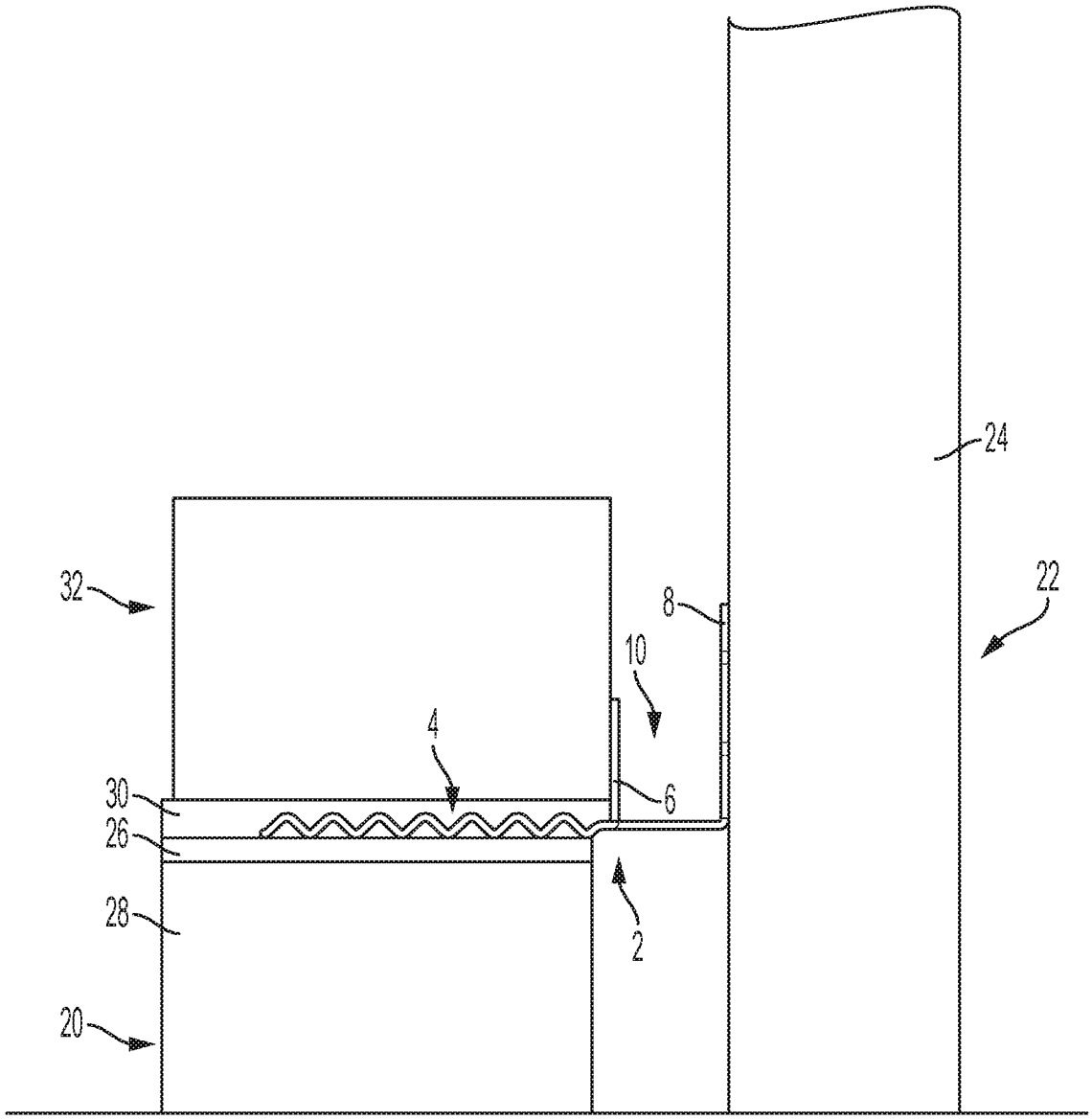
FIG. 6 is a side view of the brick tie of FIG. 1 positioned between two bricks and fastened to a frame structure.

With reference to FIGS. 5 and 6, the installation and use of the brick tie 2 according to one aspect of the present disclosure is now described in detail. In an initial step a first row of bricks 20 may be positioned adjacent the frame structure 22. In one aspect, the frame structure 22 may include a plurality of studs 24 extending along the length of the row of bricks 20. After the row of bricks 20 has been installed, a first layer of mortar 26 may be applied to the upper surface of the bricks 20. A brick tie 2 may then be positioned on top of the first layer of mortar 26 above one of the bricks 28. In one aspect, the bottom surface of the body member 4 is positioned on an upper surface of the first layer of mortar 26. It is also contemplated, in another example of the present disclosure, that the brick tie 2 could be flipped during installation such that the top surface of the body member 4 is positioned on the upper surface of the first layer of mortar 26. The brick tie 2 may be oriented such that the second protrusion 8 is positioned adjacent to and in contact with one of the studs 24 of the frame structure 22. The brick tie 2 may then be fastened to the stud 24 by inserting a fastener through each aperture 12 of the second protrusion and into the stud 24. In one aspect, a plurality of brick ties 2 may be positioned along the first row of bricks 20 and fastened to respective studs 24 of the frame structure 22.

After the plurality of brick ties 2 have been fastened to the respective studs 24 of the frame structure 22, a second layer of mortar 30 may be applied along the length of the first row of bricks 20 and the top surface of the body member 4 of the plurality of brick ties 2. In one aspect, the first layer of mortar 26 and the second layer of mortar 30 may bond with one another by extending and flowing through the apertures 18 defined in the first portion 14 of the body member 4 of each brick tie 2. After the second layer of mortar 30 has been applied, a second row of bricks 32 may be positioned on a top surface of the second layer of mortar 30. Some of the bricks of the second row of bricks 32 may be positioned on top of a brick tie 2. The respective brick may be pushed towards the frame structure 22 to abut against the first protrusion 6 of the brick tie 2. The first protrusion 6 of the brick ties 2 may be configured to serve as a stop for the bricks. The first protrusion 6 may ensure that each brick is properly spaced from the frame structure 22 to maintain the clearance gap between the bricks and the frame structure 22. The first row of bricks 20 and the second row of bricks 32 may be adhered or connected to one another by the first and second layers of mortar 26, 30. The process described above may be used to stack multiple rows of bricks on top of one another while also maintaining the clearance gap between the brick cladding and the frame structure 22.

While several examples of a brick tie were shown in the accompanying figures and described in detail hereinabove, other examples will be apparent to, and readily made by, those skilled in the art without departing from the scope and spirit of the disclosure. Accordingly, the foregoing description is intended to be illustrative rather than restrictive. The apparatus of the present disclosure described hereinabove is defined by the appended claims and all changes to the disclosed apparatus that fall within the meaning and range of equivalency of the claims are to be embraced within their scope.

The invention claimed is:

1. A brick tie, comprising:

a body member comprising: a first portion comprising a plurality of ridges and grooves and at least one aperture defined therein; and a second portion that is substantially planar;

a first protrusion extending from a first location of the second portion on the body member; and a second protrusion extending from a second location of the second portion on the body member, the second protrusion comprising at least one aperture, wherein the first and second protrusions extend vertically in the same direction relative to the body member, the width of the first protrusion extends from an edge on one side of the body member to a point before an edge of an opposite side of the body member, and the width of the second protrusion extends from the edge of one side of the body member to the edge of the opposite side of the body member in which the first protrusion has a smaller width than the body member and second protrusion, wherein the first protrusion is positioned between the second protrusion and the first portion of the body member, wherein a gap is defined between the first and second protrusions in the first portion of the body member, the gap forming a space through the second portion of the body member between the first and second protrusions, and wherein the first and second protrusions extend at a substantially 90° angle from the body member.

2. The brick tie of claim 1, wherein the first protrusion has a shorter length than the second protrusion.

3. The brick tie of claim 1, wherein the body member, the first protrusion and the second protrusion have a substantially rectangular shape.

4. A building structure, comprising:

a brick cladding; and a frame structure spaced from the brick cladding, wherein at least one brick tie is positioned within the brick cladding to maintain a gap between the brick cladding and the frame structure, wherein the brick tie comprises:

a body member comprising: a first portion comprising a plurality of ridges and grooves and at least one aperture defined therein; and a second portion that is substantially planar;

a first protrusion extending from a first location of the second portion on the body member; and a second protrusion extending from a second location of the second portion on the body member, the second protrusion comprising at least one aperture, wherein the first and second protrusions extend vertically in the same direction relative to the body member, the width of the first protrusion extends from an edge on one side of the body member to a point before an edge of an opposite side of the body member, and the width of the second protrusion extends from the edge of one side of the body member to the edge of the opposite side of the body member in which the first protrusion has a smaller width than the body member and second protrusion, wherein the first protrusion is positioned between the second protrusion and the first portion of the body member, wherein a gap is defined between the first and second protrusions in the first portion of the body member, the gap forming a space in the second portion of the body member between the first and second protrusions, and wherein the first and second protrusions extend at a substantially 90° angle from the body member.

5. The building structure of claim 4, wherein the first protrusion has a shorter length than the second protrusion.

6. A method of installing a brick cladding with a frame structure, the method comprising:

positioning a first row of bricks adjacent the frame structure;

providing a first layer of mortar on the first row of bricks;

positioning at least one brick tie on the first layer of mortar;

fastening the brick tie to the frame structure;

providing a second layer of mortar on the brick tie and the first layer of mortar; and positioning a second row of bricks on the second layer of mortar, wherein at least one brick of the second row of bricks abuts the first protrusion on the brick tie, wherein the brick tie comprises:

a body member comprising: a first portion comprising a plurality of ridges and grooves and at least one aperture defined therein; and a second portion that is substantially planar;

a first protrusion extending from a first location of the second portion on the body member; and a second protrusion extending from a second location of the second portion on the body member, the second protrusion comprising at least one aperture, wherein the first and second protrusions extend vertically in the same direction relative to the body member, the width of the first protrusion extends from an edge on one side of the body member to a point before an edge of an opposite side of the body member, and the width of the second protrusion extends from the edge of one side of the body member to the edge of the opposite side of the body member in which the first protrusion has a smaller width than the body member and second protrusion, wherein the first protrusion is positioned between the second protrusion and the first portion of the body member, wherein a gap is defined between the first and second protrusions in the first portion of the body member, the gap forming a space in the second portion of the body member between the first and second protrusions, and wherein the first and second protrusions extend at a substantially 90° angle from the body member.

7. The method of claim 6, wherein the first protrusion has a shorter length than the second protrusion.

* * * * *